US005370390A

United States Patent [19]

Swanson

[11] Patent Number: 5,370,390

[45] Date of Patent: Dec. 6, 1994

[54] ILLUMINATED CROQUET SET

[76] Inventor: Wayne L. Swanson, 221 W. Spruce St., Ceresco, Nebr. 68017

[21] Appl. No.: 142,181

[22] Filed: Oct. 26, 1993

[51] Int. Cl.[5] ..... A63B 59/10

[52] U.S. Cl. ..... 273/56; 273/DIG. 24

[58] Field of Search ..... 273/DIG. 24, 83, 56

[56] References Cited

U.S. PATENT DOCUMENTS

| | | | |
|---|---|---|---|
| 280,807 | 7/1883 | Farley . | |
| 716,645 | 12/1902 | Ransom . | |
| 3,464,703 | 9/1969 | Vallas | 273/DIG. 24 |
| 3,649,028 | 3/1972 | Worrell | 273/DIG. 24 |
| 3,649,029 | 3/1972 | Worrell | 273/DIG. 24 |
| 3,709,495 | 1/1973 | Krombein | 273/DIG. 24 |
| 3,717,343 | 2/1973 | Hartford | 273/DIG. 24 |
| 3,917,264 | 11/1975 | Davidson | 273/DIG. 24 |
| 3,918,719 | 11/1975 | Welch | 273/DIG. 24 |
| 4,295,650 | 10/1981 | Keeble | 273/83 |
| 4,479,649 | 10/1984 | Newcomb | 273/DIG. 24 |
| 4,695,055 | 9/1987 | Newcomb | 273/DIG. 24 |
| 4,846,475 | 7/1989 | Newcomb | 273/DIG. 24 |
| 4,913,347 | 4/1990 | Newcomb | 273/DIG. 24 |

FOREIGN PATENT DOCUMENTS

| | | | |
|---|---|---|---|
| 351 | of 1894 | United Kingdom | 273/56 |
| 4314 | of 1898 | United Kingdom | 273/56 |

*Primary Examiner*—Theatrice Brown

*Attorney, Agent, or Firm*—Zarley, McKee, Thomte, Voorhees & Sease

[57] ABSTRACT

A croquet set includes a mallet, ball, wicket, and stake, each of which has a light emitting source removably mounted to each individual component. The mallet handle is hollow and formed of a transparent material, with a chemical light stick removably mounted therein to provide light. The mallet head preferably has a groove along the outside surface of the body to removably receive a chemical light stick thereon. The croquet ball preferably has a groove formed in the outside circumference to receive a chemical light stick. The wicket includes a pair of ground engaging anchors with an inverted U-shaped light stick attached to the upper ends of the ground engaging anchors. The stake is a clear hollow tubular member with a ground engaging end. A chemical light stick is removably mounted in the stake to provide the light source.

10 Claims, 3 Drawing Sheets

ILLUMINATED CROQUET SET

TECHNICAL FIELD

The present invention relates generally to sports equipment, and more particularly to a croquet set which is modified so as to be illuminated.

BACKGROUND OF THE INVENTION

Croquet has been a popular sport for many years. However, it is believed that the popularity of the game could be increased by providing a novel croquet set which is illuminated, to permit the game to be played in the dark.

While others have attempted to illuminate various sports; equipment by coating the equipment with fluorescent paint, or other luminous substances, prior art techniques have several drawbacks. First, the luminous coating can affect the play of the ball or the mallet head in the setting of the game of croquet.

In addition, most luminous paints and the like do not give off a sufficient quantity of light for an adequate amount of time.

Other types of "glow in the dark" substances require the application of light to the substance, before the equipment will be illuminated. In such cases, the amount of time which the sports equipment "holds" the glow is quite limited.

SUMMARY OF THE INVENTION

It is therefore a general object of the present invention to provide an improved croquet set with illuminated components.

Yet another object is to provide croquet set components which are easily refilled with a luminous substance.

These and other objects will be apparent to those skilled in the art.

The croquet set of the present invention includes a mallet, ball, wicket, and stake, each of which has a light emitting source removably mounted to each individual component, so each component can be seen in the dark. The mallet handle is hollow and formed of a transparent material, with a chemical light stick removably mounted therein to provide light. The mallet head preferably has a groove along the outside surface of the body to removably receive a chemical light stick thereon. In a second embodiment of the mallet head, apertures are drilled through the head and a chemical light stick is inserted within the aperture. In the second embodiment of the mallet head, the head is formed of a transparent plastic material. The croquet ball preferably has a groove formed in the outside circumference to receive a chemical light stick. In the second embodiment of the ball, the ball is formed of a transparent plastic material and has an aperture formed through the diameter thereof to receive a light stick. The wicket includes a pair of ground engaging anchors with an inverted U-shaped light stick attached to the upper ends of the ground engaging anchors. In a second embodiment of the invention, a clear hollow tubular member is attached to the ground engaging anchors, and a chemical light stick is removably mounted within the tubular member. The stake is a clear hollow tubular member with a ground engaging end. A chemical light stick is removably mounted in the stake to provide the light source.

DESCRIPTION OF THE PREFERRED EMBODIMENTS

Figure 2:
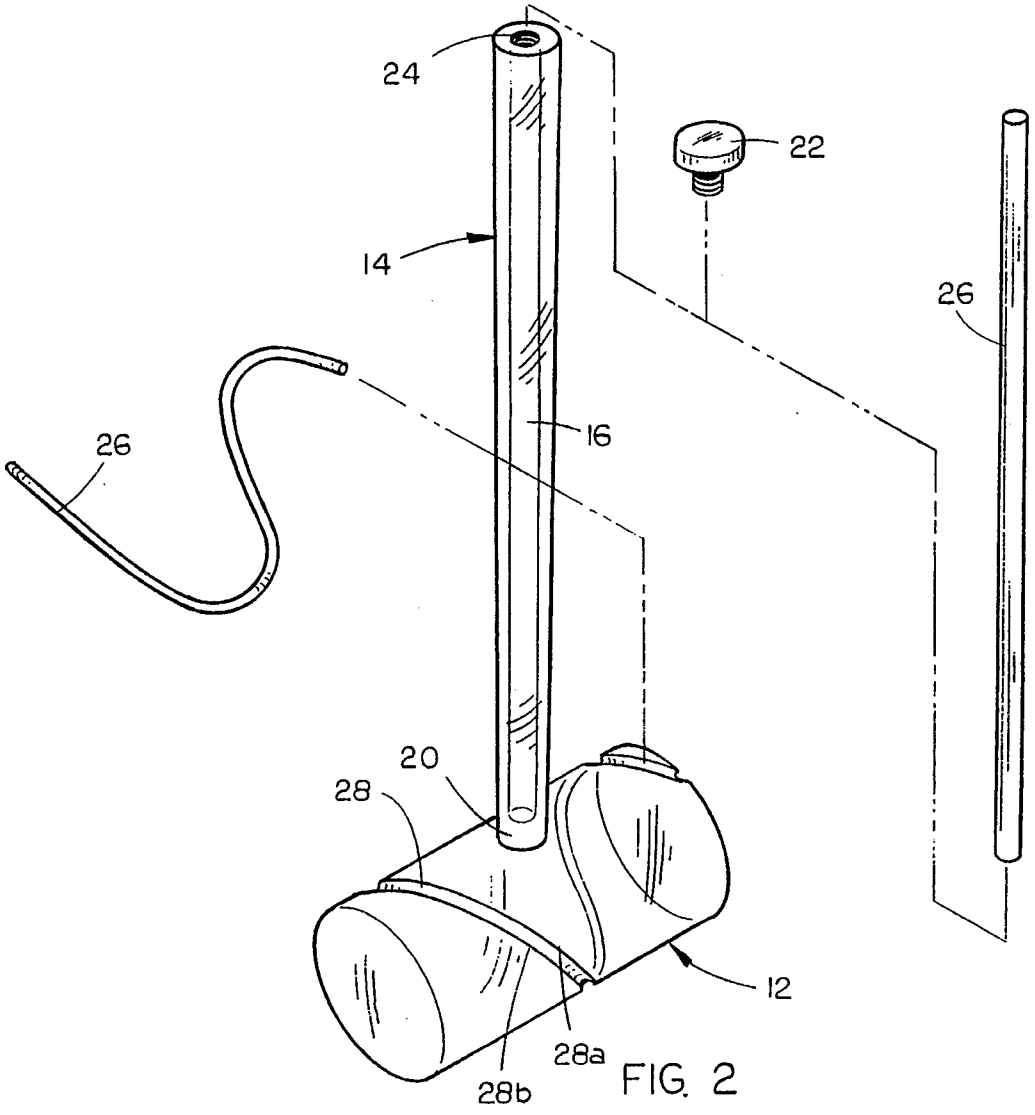
FIG. 2 is an exploded perspective view of the mallet of FIG. 1.
Figure 1:
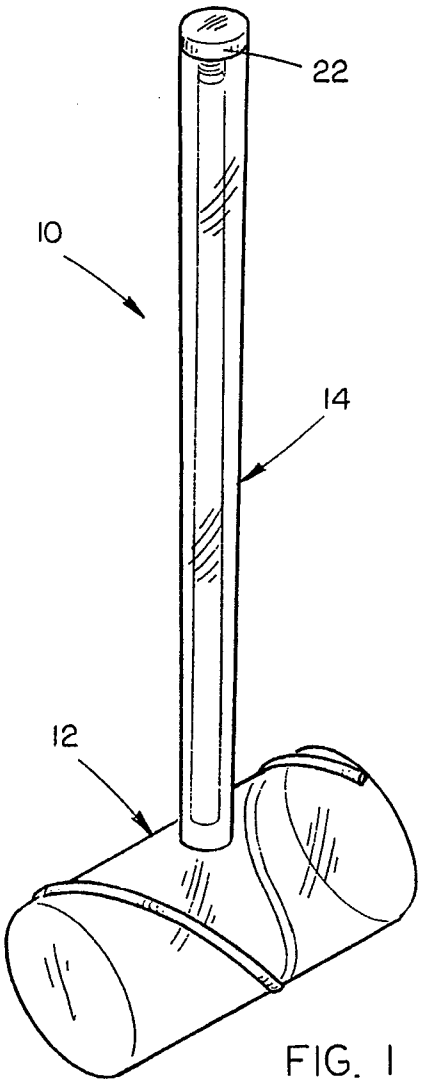
FIG. 1 is a perspective view of a croquet mallet of the present invention.

Referring now to the drawings, in which corresponding or similar parts are identified with the same reference numeral, and more particularly to FIGS. 1 and 2, a croquet mallet of the present invention is designated generally at 10 and includes a head portion 12 and a handle portion 14.

Handle portion 14 includes an elongated rigid hollow tubular member 16 formed of a transparent or translucent material. Tubular member 16 includes an upper end 18 and lower end 20 with lower end 20 fastened to head 12. Upper end 18 includes a removable cap 22 which permits access to the hollow interior of tubular member 16. The hollow cavity 24 formed within tubular member 16 is of a length and diameter so as to receive a conventional chemical light stick such as that sold under the brand name "Glow Stick" by Omniglow Corporation.

Chemical light stick 26 is of a type which will become illuminated when the chemicals within the light stick are intermixed, by sharply bending the light stick 26. The luminescence remains for a number of hours, and will illuminate handle 16.

Mallet head 12 is generally cylindrical and oriented with the longitudinal axis thereof perpendicular to the longitudinal axis of handle 16. Head 12 has a groove 28 formed in the peripheral cylindrical surface thereof for receiving the elongated cylindrical shape of a light stick 26. Preferably, groove 28 has a cross-sectional shape slightly greater than semicircular, such that the distance between groove edges 28*a* and 28*b* is less than the diameter of light stick 26. In this way, light stick 26 is snap fit into groove 28. Obviously, other methods of removably attaching a light stick 26 within groove 28 are possible.

As with handle 16, a light stick 26 is first activated to produce light, and then inserted within groove 28, to illuminate mallet head 12.

Figure 3:
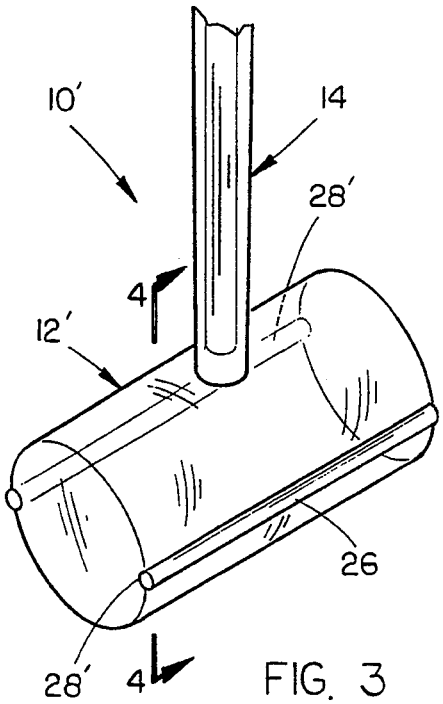
FIG. 3 is a partial perspective view of a second embodiment of the croquet mallet.
Figure 4:
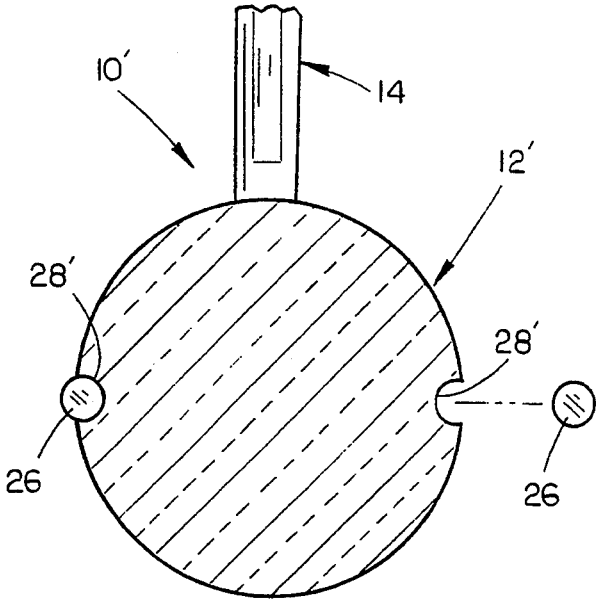
FIG. 4 is a sectional view taken at lines 4—4 in FIG. 3.

Referring now to FIGS. 3 and 4, a second embodiment of the croquet mallet is designated generally at 10' and includes the same handle 14, but with a modified mallet head 12'. While the groove 28 formed in mallet head 12 (as shown in FIG. 2) is preferably spiral cut around the cylindrical surface of the mallet head, the second embodiment of the invention includes a pair of elongated straight grooves 28' located diametrically and parallel to the longitudinal axis of mallet head 12'. Light sticks 26 are then removably attached in grooves 28'.

Figure 5:
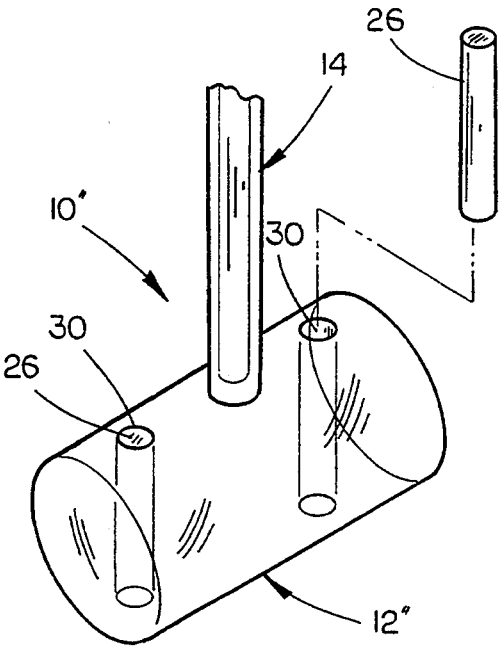
FIG. 5 is a partial perspective view of a third embodiment of the croquet mallet.

While it is preferable that the mallet head 12 and 12' of the first two embodiments of the invention are clear solid material, the location of the light stick 26 around the circumference of the material does not necessitate such material. As shown in FIG. 5, a third embodiment of the mallet 10'' includes a cylindrical mallet head 12'' which must be formed of a transparent or translucent material. In this third embodiment, a pair of vertical apertures 30 are formed through the diameter of mallet head 12''. Light sticks 26, formed to a length equal to the diameter of the mallet head 12'', are then inserted within apertures 30. The transparent or translucent material is necessary to provide the desired viewing of light sticks 26.

Figure 6:
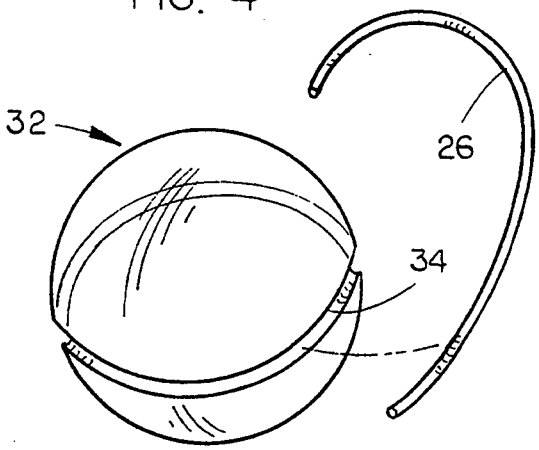
FIG. 6 is an exploded perspective view of a croquet ball of the present invention.

Referring now to FIG. 6, a croquet ball 32 is shown, formed of a solid material and having an annular groove 34 formed in the circumference thereof. Annular groove 34 is similar to that of groove 28 in the mallet head, and is designed to receive a chemical light stick 26 therein with a snap fit. It should be noted that groove 34 must be of a depth at least equal to the diameter of the light stick 26, such that no portion of the light stick projects from the circumference of the ball. Otherwise, the light stick would affect the rolling characteristics of ball 32.

Figure 7:
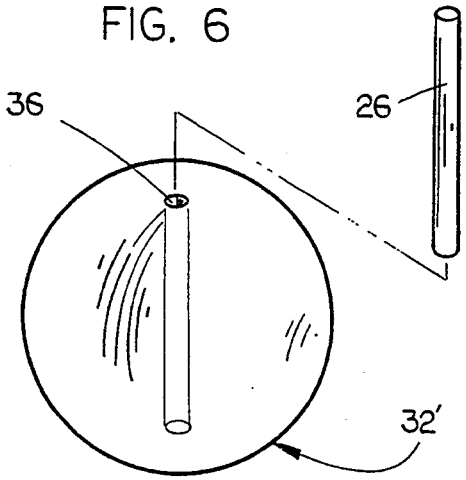
FIG. 7 is an exploded perspective view of a second embodiment of a croquet ball.

FIG. 7 shows a second embodiment of a croquet ball, designated generally at 32'. Ball 32' has an aperture 36 formed through the diameter thereof adapted to receive a short chemical light stick 26. Ball 32' is formed of a solid transparent or translucent material such that light stick 26 will cause the ball to be illuminated.

Figure 8:
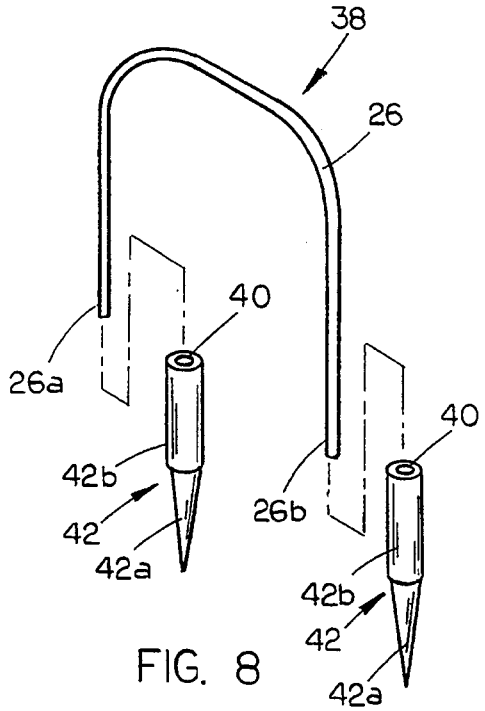
FIG. 8 is a perspective view of a wicket of the present invention.
Figure 9:
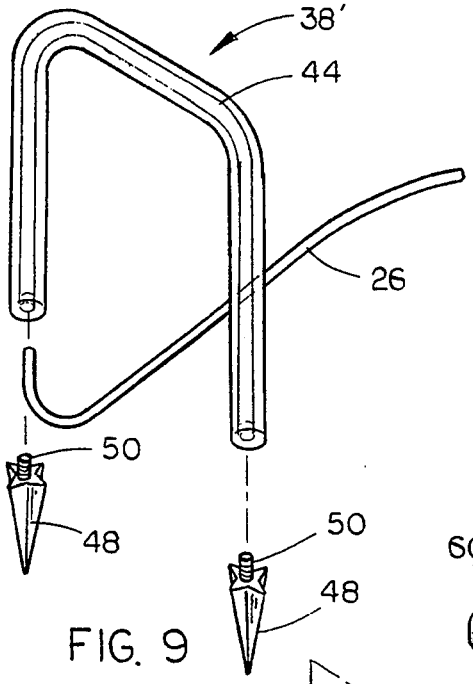
FIG. 9 is an exploded perspective view of a second embodiment of a wicket.
Figure 10:
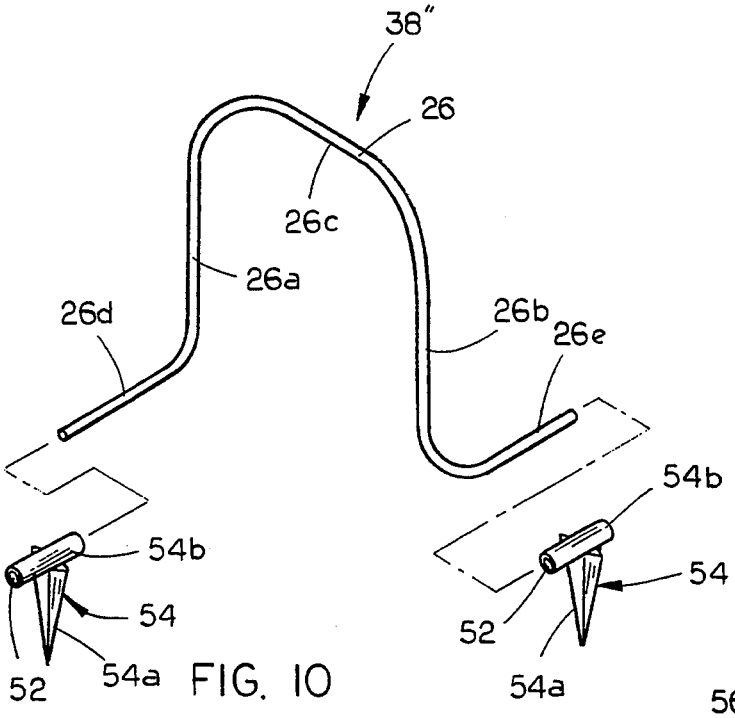
FIG. 10 is an exploded perspective view of a third embodiment of a wicket.

FIGS. 8–10 show three embodiments of a wicket 38, 38' and 38'', utilized with the croquet set of the present invention. In FIG. 8, wicket 38 is formed of a chemical light stick which has been bent to form an inverted U-shape. The ends **26*a* and 26*b* of light stick 26 are inserted within apertures 40 in the upper end of ground engaging spikes 42. The lower ends of spikes 42 are pointed to permit easy insertion into the ground. The upper end of spikes 42 have an upright tubular portion 42*b* of sufficient length to retain light stick 26 in the generally inverted U-shaped position. Preferably, at least upper tubular portion 42*b* of spikes 42 is formed of a transparent or translucent material, such that the entire light stick 26** may be viewed.

The second embodiment of the wicket is designated generally at 38' in FIG. 9, and includes an inverted generally U-shaped transparent tubular member 44 having a hollow tubular aperture 46 therein for receiving a chemical light stick 26. Ground engaging anchors 48 each have a peg 50 projecting upwardly therefrom which may be inserted tubular aperture 46 of tubular member 44 to support tubular member 44 in an upright position on the ground. The transparent or translucent material utilized for tubular member 44 permits illumination of wicket 38' by chemical light stick 26.

Referring now to FIG. 10, a third embodiment of the wicket is designated generally at 38'' and is preferably formed of an elongated light stick 26 bent into an inverted U-shaped form having a pair of vertical legs **26*a* and 26*b* connected by a cross-member 26*c*. The lower end of legs 26*a* and 26*b* each include an extension 26*d* and 26*e*, respectively, which are bent in opposite directions and oriented parallel to one another. The free ends of extensions 26*d* and 26*e* are inserted within a horizontal tubular aperture 52 formed in the upper end of a ground anchor 54. Ground anchors 54 each include a lower ground engaging pointed portion 54*a* and a horizontal tubular upper member 54*b*, with aperture 52 formed in upper member 54*b***.

Figure 11:
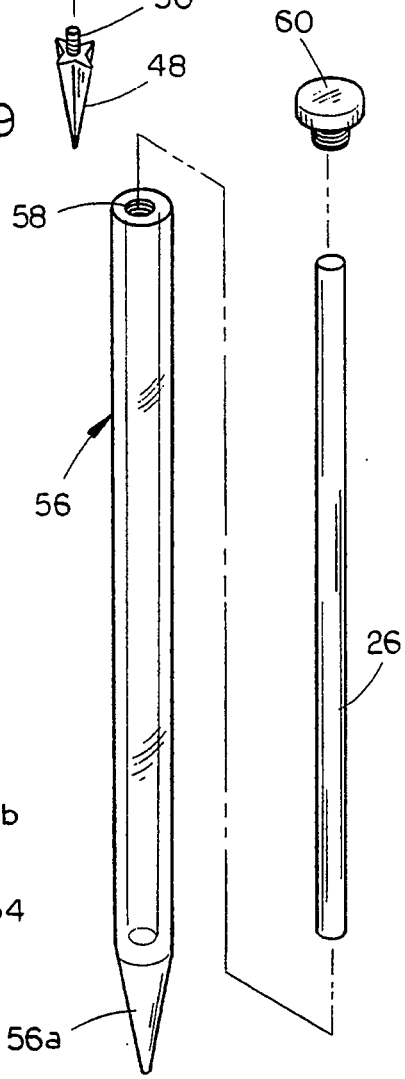
FIG. 11 is an exploded perspective view of a stake of the croquet set of the present invention.

Finally, an end stake 56 is shown in FIG. 11 and is formed of a transparent or translucent rigid material. Stake 56 has a sharpened lower end **56*a* for insertion within the ground. Stake 56 is an elongated tubular member with a vertical tubular aperture 58 formed therein for receiving a chemical light stick 26. A cap 60 seals aperture 58 to retain light stick 26 within stake 56**.

Each component of the croquet set of the present invention includes structure to permit easy replacement of the illumination source (a chemical light stick). In this way, the croquet set may be utilized over and over, by merely replacing the illumination source, rather than having to replace each component of the croquet set.

Whereas the invention has been shown and described in connection with the preferred embodiments thereof, it will be understood that many modifications, substitutions and additions may be made which are within the intended broad scope of the appended claims. There has therefore been shown and described an improved croquet set which accomplishes at least all of the above stated objects.

I claim:

1. A croquet set, comprising:

a croquet mallet having an elongated handle portion with upper and lower ends;

said mallet handle portion having a cylindrical aperture therein extending from the upper to the lower end;

a head portion mounted to the lower end of the handle, having at least one ball contacting surface formed thereon;

light emitting means removably mounted within said handle aperture;

said handle portion formed of material which will transmit light therethrough;

said mallet head having light emitting means removably mounted thereon;

a solid croquet ball having light emitting means removably mounted thereon;

a croquet wicket formed from a chemical light stick having a resilient elongated body formed into an inverted generally U-shaped orientation, and ground engaging means for removably engaging the ends of the light stick to the ground; and a croquet stake including an upright tubular member having an aperture extending substantially the entire length thereof;

said stake including a lower portion with ground engaging means thereon;

light emitting means removably mounted within said stake aperture; and said stake formed of a material which will transmit light therethrough.

2. The croquet set of claim 1, wherein said mallet handle and stake are formed of transparent material.

3. The croquet set of claim 1, wherein said light emitting means are chemical light sticks having resilient flexible elongated cylindrical housings.

4. The croquet set of claim 1, further comprising a truncated cylindrical groove extending generally longitudinally along the surface of the cylinder of a size to receive a light stick of a predetermined diameter.

5. The croquet set of claim 3, wherein said ball has a truncated cylindrical groove extending around the circumference thereof having a diameter adapted to receive a light stick of a predetermined diameter therein.

6. The croquet set of claim 1, further comprising a removable cap for selectively closing said mallet handle aperture.

7. A croquet set, comprising:

a croquet mallet having an elongated handle portion with upper and lower ends;

said mallet handle portion having a cylindrical aperture therein extending from the upper to the lower end;

a generally cylindrical head portion mounted to the lower end of the handle having at least one ball contacting surfaced formed thereon;

light emitting means removably mounted within said handle aperture;

said handle portion formed of material which will transmit light therethrough;

said mallet head having light emitting means removably mounted thereon;

a solid croquet ball having light emitting means removably mounted thereon;

a croquet wicket having removable light emitting means extending in an inverted generally U-shaped orientation, and ground engaging means for removably engaging the wicket to the ground;

a croquet stake including an upright tubular member having an aperture extending substantially the entire length thereof;

said stake including a lower portion with ground engaging means thereon;

light emitting means removably mounted within said stake aperture;

said stake formed of a material which will transmit light therethrough;

said light emitting means being chemical light sticks having resilient flexible elongated cylindrical housings;

a truncated cylindrical groove extending generally longitudinally along the surface of the mallet head of a size to receive a light stick of a predetermined diameter; and said groove extending in a spiral around the circumference of the head.

8. A croquet set, comprising:

a croquet mallet having an elongated handle portion with upper and lower ends;

said mallet handle portion having a cylindrical aperture therein extending from the upper to the lower end;

a generally cylindrical head portion mounted to the lower end of the handle having at least one ball contacting surfaced formed thereon;

light emitting means removably mounted within said handle aperture;

said handle portion formed of material which will transmit light therethrough;

said mallet head having light emitting means removably mounted thereon;

a solid croquet ball having light emitting means removably mounted thereon;

a croquet wicket including a hollow tubular member with light emitting means removably mounted therein, said tubular member being formed of a material which transmits light therethrough and formed in a generally inverted U-shape;

said wicket including ground engaging means for removably engaging said tubular member and supporting the tubular member above the ground;

a croquet stake including an upright tubular member having an aperture extending substantially the entire length thereof;

said stake including a lower portion with ground engaging means thereon;

light emitting means removably mounted within said stake aperture;

said stake formed of a material which will transmit light therethrough;

said light emitting means being chemical light sticks having resilient flexible elongated cylindrical housings;

a truncated cylindrical groove extending generally longitudinally along the surface of the mallet head of a size to receive a light stick of a predetermined diameter; and said groove extending in a spiral around the circumference of the head.

9. The croquet set of claim 8, wherein said wicket ground engaging means includes first and second anchors having a lower pointed end for engaging the ground and an upper end with means for removably attaching one end of said hollow tubular member.

10. The croquet set of claim 8, wherein said wicket ground engaging means includes first and second anchors having a lower pointed end for engaging the ground and an upper hollow tubular end for receiving one end of a light stick therein.

* * * * *